US005352032A

United States Patent [19]

Cisternino

[11] Patent Number: 5,352,032

[45] Date of Patent: Oct. 4, 1994

[54] ADJUSTABLE CABINET SYSTEM

[75] Inventor: Andrew J. Cisternino, Marietta, Ga.

[73] Assignee: Ask Research & Development, Inc., Norcross, Ga.

[21] Appl. No.: 959,780

[22] Filed: Oct. 13, 1992

[51] Int. Cl.[5] ..... A47B 47/00

[52] U.S. Cl. ..... 312/265.3; 312/195; 312/263

[58] Field of Search ..... 312/265.1, 265.2, 265.3, 312/263, 141.1, 257.1

[56] References Cited

U.S. PATENT DOCUMENTS 4,187,649 2/1980 Chaffee ..... 52/36
4,632,473 12/1986 Smith ..... 312/265.1
4,750,794 6/1988 Vegh ..... 312/257.1
4,782,972 11/1988 Wenkman et al. ..... 312/263
4,958,259 9/1990 Berg et al. ..... 312/265.2 X
4,973,110 11/1990 Nyquist ..... 312/265.3

*Primary Examiner*—Peter R. Brown
*Assistant Examiner*—Nancy Mulcare

[57] ABSTRACT

The system of the present invention generally includes a base member, a plurality of frame members and means on the frame members and the base member for securing the frame members in an upright position at selected intervals along the length of the base member. The system further includes means on the frame member for receiving between adjacent pairs of the frame members a cabinet component.

13 Claims, 3 Drawing Sheets

ADJUSTABLE CABINET SYSTEM

BACKGROUND OF THE INVENTION

There has long existed a need for cabinetry that could be rapidly and inexpensively installed in multi-retail establishments, such as fast food restaurants, convenience stores, gas stations, etc. This need has previously been met, to a limited degree, by modular furniture components such as cabinets, drawer banks, shelving and the like, etc. This modular furniture generally comprises independent, pre-formed units of the desired furniture type. These units are generally shipped to the installation site and fastened to each other or to existing structures, such as walls and floors, to form the desired modular system. These pre-formed, modular units typically are available in 1, 2 or 3 foot wide units.

Therefore, the degree of adjustability and flexibility of such modular furniture systems is limited to the size of the units available, and no smaller or intermediate incremental adjustments are generally possible. Furthermore, existing modular furniture systems are difficult to adjust at the site of installation if the space into which the modular units must fit is slightly less or slightly greater than the combined size of the available modular units. In the event that such a situation arises as a result of a measuring error or a change in the installation site, a custom-made cabinet unit has to be constructed to accommodate the off-sized space to be filled.

A further disadvantage of currently available modular cabinet units is that they must be shipped as a unit from the site of manufacture to the site of installation. This can result in high shipping costs as the size of a premanufactured modular unit is much larger than the size of its components parts. This cost disadvantage can be prohibitive when the site of manufacture and the site of installation are distant.

Once a system of modular cabinetry units is installed at a site, the appearance of the units cannot later be altered in a significant manner. Thus, if a business establishment such as those mentioned above changes hands and/or changes the nature of the service to be provided by the cabinet system, a new modular cabinet system must generally be purchased and the existing cabinet system removed and discarded. Thus, this inability of presently known modular furniture systems to be post-adapted to alter their appearance or function is a further disadvantage of modular furniture systems.

SUMMARY OF THE INVENTION

The disadvantages of the prior art are overcome by the present invention, which provides a system for assembling cabinet components in adjustable relationship to each other to provide flexibility and other advantages absent in existing modular furniture systems. The system of the present invention generally includes a base member, a plurality of frame members and means on the frame members and the base member for securing the frame members in an upright position at selected intervals along the length of the base member. The system further includes means on the frame member for receiving between adjacent pairs of the frame members a cabinet component.

DETAILED DESCRIPTION OF THE INVENTION

Figure 1:
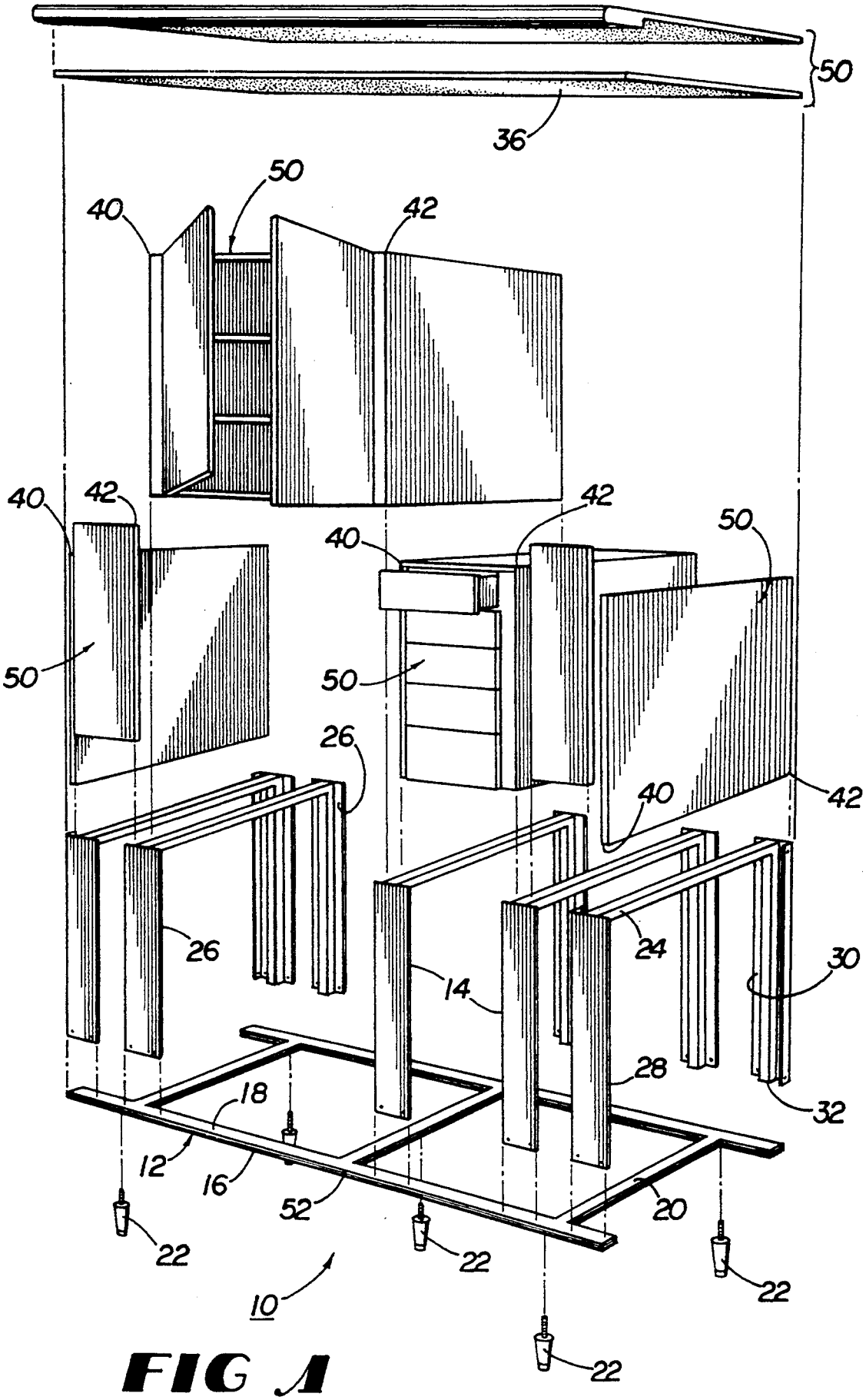
FIG. 1 is an exploded perspective of the adjustable cabinet system of the present invention.
Figure 2:
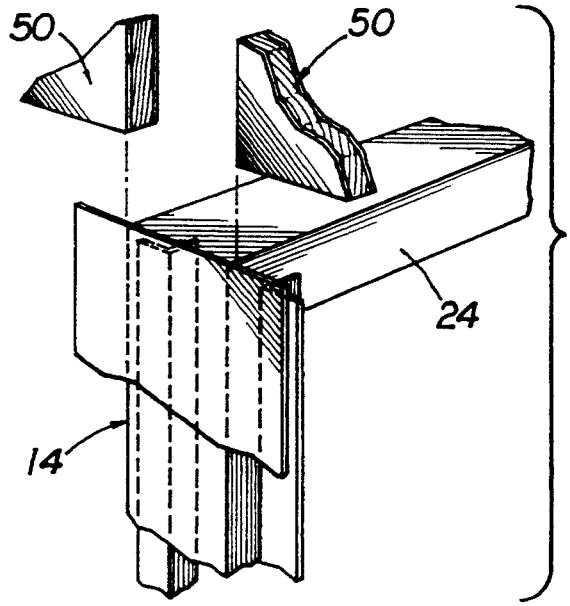
FIG. 2 is a perspective view of a frame member in accordance with the present invention.
Figure 3:
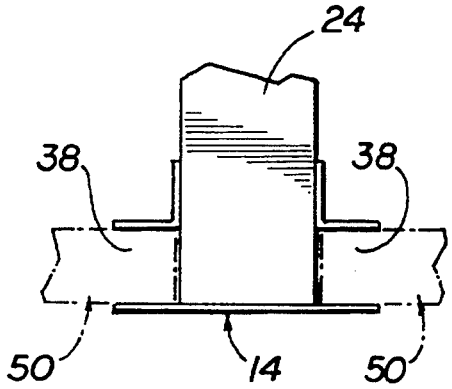
FIG. 3 is a top plan view of the frame member shown in FIG. 2.

The system 10 of the present invention as depicted in FIGS. 1–9, generally includes a base member 12, a plurality of frame members 14 and means on the frame members 14 and the base member 12 for securing the frame members 14 in an upright position at selected intervals along the length of the base member 12. The system 10 further includes means on the frame member 14 for receiving between adjacent pairs of the frame members a cabinet component 50.

Base member 12 can include at least two spaced apart, parallel, longitudinally extending members 16, each having at least one surface 18 for bearing a portion of the weight of a frame member 14 secured thereon. The base member 12 must also include means for rigidly interconnecting the two longitudinally extending members 16. The means for rigidly interconnecting the two longitudinally extending members 16 can be cross braces 20, such as those depicted in FIG. 1. The cross braces 20 can be welded, glued or otherwise fastened to the longitudinally extending members 16, or the base member 12 can be cast as a unitary structure integrally comprising the longitudinally extending members 16 and cross braces 20 for rigidly interconnecting the longitudinally extending members 16. The number and construction of cross braces 20 will depend on the length of the base member 12 and the use to which the system will be put. Such determinations will be based on standard engineering criteria. The base member 12 can be constructed in any desired shape, including triangular or L-shaped, in which instances the longitudinally extending members 16 can be non-parallel, but will still be rigidly interconnected by at least one rigid interconnecting means. The base member 12 can also include legs 22, which will be selected based on standard criteria to accommodate the weight of the base member 12, frame member 14 and cabinet components at the appropriate height above the floor. The base member 12 can, alternatively, be positioned atop a baseboard unit engineered so as to support the base member 12 at the appropriate height above the floor or other support surface.

The shape of the longitudinally extending members 16 and the rigid interconnecting means of the base member 12 can be selected from a variety of shapes for structural components, being limited only by their ability to form a base member capable of bearing the weight of the frame members 14 and cabinet components. For example, the base member 12 could be constructed of angular or tubular aluminum, stainless steel, mild steel or plastic. The base member 12 can also be constructed of wood.

Figure 4:
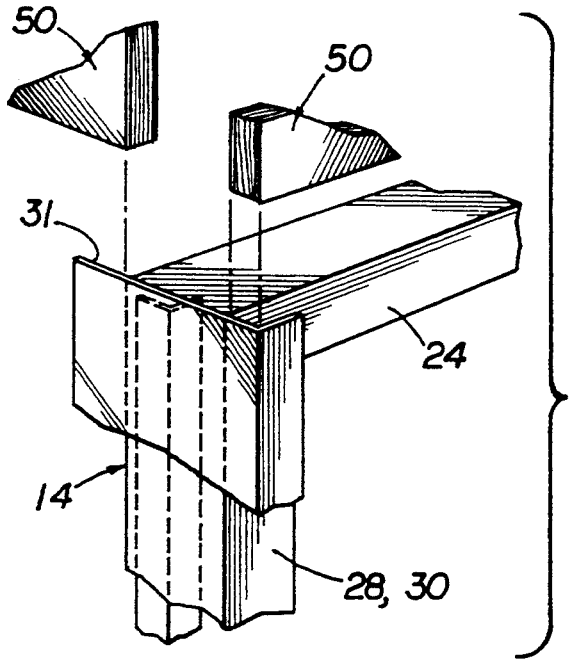
FIG. 4 is a perspective view of a corner frame member in accordance with the present invention.
Figure 5:
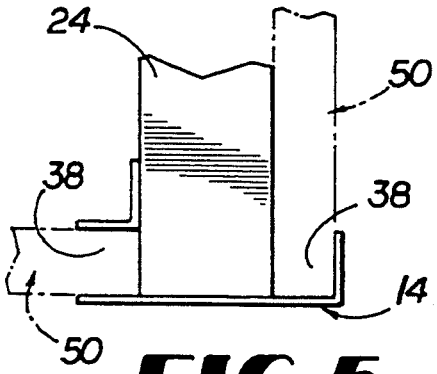
FIG. 5 is a top plan view of the frame member shown in FIG. 4.
Figure 6:
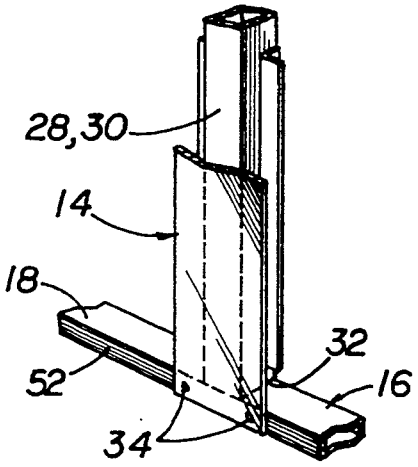
FIG. 6 is a perspective view of a frame member secured to a base member in accordance with the present invention.

The frame members 14 of the present system 10 are depicted in FIGS. 2–9 where it can be seen that each frame member 14 includes an elongated top portion 24 with opposed ends 26, the top portion 24 being generally parallel to the base member 12. First and second leg portions 28, 30, depend downwardly from each end of the top portion 24 and terminate in a bottom surface 32. A portion of each bottom surface 32 will be complimentary to a respective bearing surface 18 on each longitudinally extending member 16 of the base member 12. As shown in FIG. 6, the complimentary bottom surface 32 of the frame member 14 can be the flat bottom surface 32 of downwardly depending first and second leg portions 28, 30. The bottom surface 32 can also include an extension from the flat bottom surface 32 of the downwardly extending leg which is capable of butting up against an additional bearing surface 52 of the longitudinally extending member 16 of the base member 12. Thus, the bearing surface 18 on the base member 12 and the complimentary bottom surface 32 of the frame member 14 are means for securing the frame members in an upright position on the base member 12.

Once the frame member 14 has been positioned on the base member 12, as shown in FIG. 1 and FIG. 6, the frame member 14 can be further secured to the base member 12 using standard mechanical fastening means, including screws 34, bolts, clamps, etc. In addition or alternatively, other means such as gluing and welding, could be used to further secure the frame members 14 to the base members 12. Thus, when in position, the frame members 14 will extend upwardly from the base member 12 at substantially right angles to the base member 12.

As shown in FIG. 1, the present system 10 can include a cabinet component 50 that is a countertop. In such cases, the top portion 24 of each frame member 14 engages the lower surface 36 of the countertop when the countertop and the frame member 14 are in assembled relationship. With the top portion 24 of each frame member 14 being parallel to the base member 12, it will be understood that the countertop will also be parallel to the base member 12. However, if a slanted cabinet component 50 such as a display shelf is to be positioned atop the frame members 14, frame members can be constructed such that the top portion 24 is also slanted in the proper direction and at the proper angle. Regardless of its level, the countertop can be fastened to the top portion 24 or the upper end of the first and second leg portions 28, 30 of each frame member 14 to enhance the stability of the cabinet assembly. A variety of countertops can be used with the present cabinet component system 10, which is in no way limited by the type of countertop used.

Figure 7:
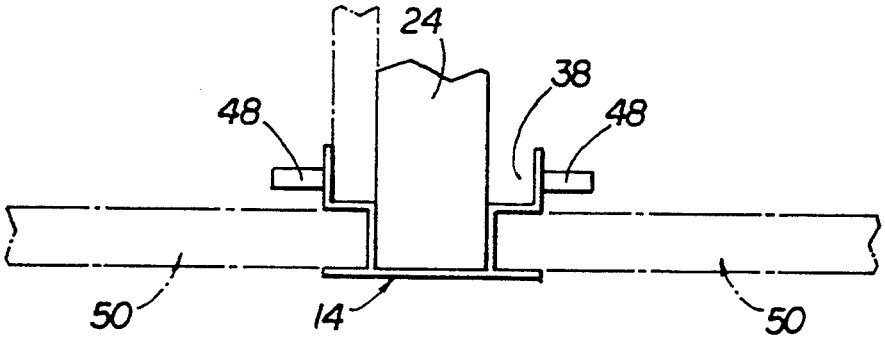
FIG. 7 is a top plan view of a frame member in accordance with the present invention.
Figure 8:
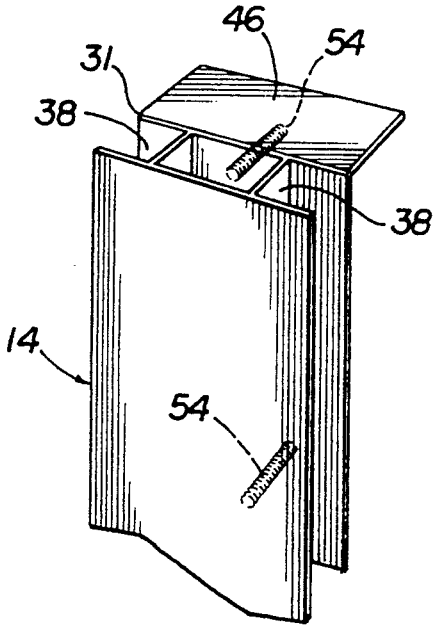
FIG. 8 is a perspective view of a frame member in accordance with the present invention.
Figure 9:
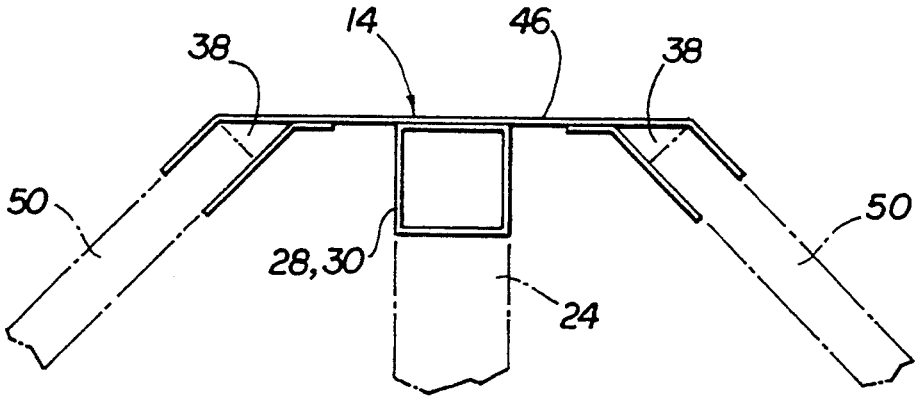
FIG. 9 is a top plan view of a corner frame member in accordance with the present invention.

As depicted in the figures, the means on the frame members 14 for receiving portions of the cabinet component 50 can comprise channels 38 carried longitudinally and opening outwardly from a leg portion of a frame member 14. In a preferred embodiment, the leg portion has at least two opposed longitudinally extending faces each of which has a channel therethrough. As shown in FIGS. 2, 3, 6 and 8, the channels 38 can open in opposed directions from each other and are aligned with each other. This configuration of channels 38 on a frame member 14 will generally be found on frame members used in an intermediate position in a cabinet system so as to be capable of receiving cabinet components that will form a front or back face of the cabinet assembly. As shown in FIGS. 4, 5 and 9, a frame member 14 to be used on the end of a cabinet assembly to form a corner thereof, can have channels 38 on opposed faces of the first and second leg portions 28, 30 which open perpendicularly to each other for receiving the opposed side edges 40, 42 of two cabinet components at 90° angles to each other. The frame member 14 depicted in FIG. 7 has three or more channels 38, two of which are opposing and aligned as in FIG. 3, and one or more of which opens perpendicularly to the opposed and align channels 38. A frame member 14 so configured can be used in settings in which it is desired to have a cabinet component 50 such as a cabinet wall received on the first and second leg portion 28, 30 of a given frame member 14 to permit at least four-sided enclosure of the space between two adjacent frame members 14. The frame member 14 of the present system can also include additional means for receiving a cabinet component 50, such as posts 48 for receiving a shelf (FIG. 7).

As most clearly seen in FIG. 1, it is intended that both the first and second leg portions 28, 30 of a frame member 14 can have a configuration of channels 38 therethrough to allow for the placement of the appropriate cabinet component 50 on both the front and back sides, and both ends, of the cabinet assembly. Thus, although the configuration of channels 38 on the first leg portion 28 of a frame member 14 can be the mirror image of the configuration of channels 38 on the second leg portion 30, it is possible to have different channel configurations on the first and second leg portions 28, 30 of a frame member 14.

As depicted in the figures, the frame members 14 can be constructed of angular, hollow pieces of metal or plastic welded or molded to form the top portion 24 and the first and second leg portions 28, 30. The various channels 38 carried on the faces of the leg portions 28,30 can be formed using standard construction materials such as angle irons and plates positioned to form a channel 38 opening in the desired direction and having the appropriate dimensions.

Furthermore, although not specifically depicted in the figures, it will be understood that the frame members 14 can be constructed of any suitable material such as aluminum, stainless steel, mild steel, plastic or wood to be selected using standard engineering criteria based on the intended use of the cabinet assembly and the environmental surroundings of the cabinet assembly. Thus, the frame members 14 can be tubular and have channels 38 of the appropriate configuration preformed therein, or carried thereon at the appropriate position to form a channel facing in the desired direction and of the desired dimensions. Thus, the limiting parameter on the construction of the frame members 14 is that they be able to carry on various faces thereof the desired configuration of channels 38 to accomplish the function of receiving therein the various cabinet components of the cabinet assembly.

The present system 10 includes an additional corner frame member 14 shown in FIG. 9 having leg portions 28, 30 from which flanges 46 extend from opposite faces of the leg portion. Each flange 46 forms, a channel designed to receive therein a side edge of a cabinet component 50 as described above. The directions in which these channels 38 open will be determined as above with relationship to the orientation of a channel on the next adjacent frame member 14. The frame member 14 depicted in FIG. 9 is designed to form a corner of the present cabinet system 10 and to accommodate cabinet components that are placed perpendicular to each other while providing an oblique corner.

As shown in the FIG. 1, each cabinet component 50 will have opposed side edges 40, 42. When the cabinet component 50 is to form a front or back face of the cabinet assembly, the opposed side edges 40, 42 of the cabinet component 50 will be received by channels 38 on the opposed leg portions 28, 30 of adjacent frame members 14, each channel opening toward and collinear with the channel on the adjacent frame member 14. When the cabinet component 50 is to form an end of the cabinet assembly, the leg portion of the endmost or corner frame member 14 will have channels 38 configured, generally, as depicted in FIGS. 4 and 5. Thus, the outwardly opening channels 38 on the first and second leg portion 28, 30 of a frame member 14 are collinear with each other and open toward each other for receiving therein the opposed side edges 40, 42 of a cabinet component 50.

The present system 10 also provides for the modification of existing cabinet assemblies by assembling cabinet components 50 in an adjustable relationship to each other over at least a portion of the existing cabinet assembly. As with the above described cabinet assembly, the system for modifying existing cabinet assemblies will include frame members 14, each frame member, preferably, having a top surface 31 and a bottom surface 32, and at least two opposed longitudinally extending faces. The frame member 14 will also include means for receiving a cabinet component 50 therein. As with the above system, the preferred method for receiving cabinet components is a channel 38 as described above. The frame member 14 that will be used in the system 10 for modifying existing cabinet assemblies can be an "H"-shaped frame member 44 as depicted in FIG. 8. As can be see in the figure, this frame member 14 has a threaded stud 54 for fastening the frame member 14 to a portion of the existing cabinet assembly. The frame member 14 can also include a flange 46 extending outwardly from the top surface of the frame member 14 for hanging the frame member 14 on a portion of the existing cabinet assembly. This flange 46, in combination with threaded studs 54 or other standard fastening means, can secure the frame member 14 to the existing cabinet assembly. Once the frame members 14 are secured to the existing cabinet assembly in the appropriate position, cabinet components provided by the present invention can then be received within the channels 38 of the frame members 14 to modify the appearance and function of the existing cabinet assembly.

Although not specifically depicted in the figures, a frame member 14 may include only one channel. Such a frame member 14 will most likely be an end member of the cabinet assembly to abut a wall, and the channel therein will open toward and be collinear with a channel on the next adjacent frame member 14.

Although the means for receiving cabinet components have been generally described as channels 38, it will be understood that other means for fastening a cabinet component 50 to a frame member 14 are also contemplated within the present system 10. For example, the cabinet component 50 can be glued, bolted or screwed to the frame member 14, although each of these has its own disadvantages over the channels 38 described herein.

As used herein, the term "cabinet component 50" includes drawers, cabinets, shelves, panels, doors and countertops, among others. A wide variety of cabinet component shapes and sizes can be accommodated in the present assembly system 10. With respect to the preferred embodiment described above with reference to FIGS. 1–9, the cabinet component 50 need only have opposed side edges 40, 42 capable of being received within the channels 38 on the frame members 14.

The assembly of cabinet components of the present system 10 will now be described with reference to the figures. The cabinet components, frame members 14 and base member 12 can be received at the installation site in unassembled form. If the base member 12 is in individual pieces, it should first be assembled by using cross braces 20 or other fixed interconnecting means to attach the longitudinally extended members 16 to each other in the proper relationship. Then, any legs 22 or base boards can be attached to the base member 12 either on the cross braces 20 or on the longitudinally extending members 16. After the base member 12 is assembled, including the placement of any legs 22, an end frame member 14, such as that depicted in FIGS. 4, 5 or 9, is secured to the base member 12 by placing it upright on the base member 12 such that the bottom surface 32 of the first and second leg portions 28, 30 rest on a bearing surface 18 of the longitudinal extending members as shown in FIG. 1. Mechanical fasteners, such as self tapping screws 34, can be driven through an extension of bottom surface 32 into a side bearing surface 52 to tightly secure the frame member 14 to the base member 12.

A cabinet component 50 is then placed on base member 12 and slid into receiving engagement with the channels 38 on the secured frame member 14. Once the cabinet component 50 has been fit into the channels 38 on the end frame member 14, a second (intermediate) frame member is then secured to the base member 12 in a position such that an opposing side edge of the cabinet component 50 is received within the aligned channels 38 on the intermediate frame member. The second frame member can then be further secured using fastening means as described above. This process is continued along the entire length of the base member 12 until the available bearing surfaces 18 of the base member 12 bear either a frame member or a cabinet component 50 thereon. The last frame member to be secured to the base member 12 will also be an end frame member as with the first positioned frame member. Either end frame member can be as depicted in FIGS. 4, 5 and 9, or it can be as described above for a frame member 14 that is intended to butt up against a wall or other fixed surface. Next, a counter top is placed atop the assembly in engagement with the top portion 24 of the frame members 14 and fastened to the frame member 14 using any suitable means, such as standard mechanical fasteners. The engagement of the lower surface 36 of the countertop with the top portions 24 of the frame members 14 and the fastening of the countertop to the frame members 14 adds additional stability to the cabinet assembly.

If it is desired to make the cabinet assembly extend above counter height, it is possible to secure additional frame members 14 atop the already installed frame members 14 and, thereafter, to position additional cabinet components between those frame members 14. If the decision to add an additional level of cabinet components is made in the field, the premeasured, precut countertop is cut and engaged atop the remaining exposed frame members 14. Furthermore, if it is discovered in the field that the longitudinally extending members 16 of the base member 12 are too long for the existing space, they can be cut on site to the appropriate length using a saw. A portion of a cabinet component 50 can also be sawed off to accommodate the change in length of the overall system. Thereafter, any required rigid interconnecting means or legs 22 are installed to provide a sturdy base member 12, and the frame members 14 secured atop the base member 12 with cabinet components 50 received therebetween as previously described.

The new and modified cabinet systems provided by the present invention have the further advantage of being readily adaptable to provide a change in appearance of the cabinet components or the function of the cabinet system. Once the frame members 14 are secured on either a base member 12 or the structure of an existing cabinet assembly, the desired cabinet components 50 can be slid into the channels 38 on a single frame member 14 to form the end of a cabinet assembly or into channels 38 facing each other on adjacent frame members 14 to form front and rear faces of the cabinet assembly. After the cabinet components 50 have been so assembled, it is possible at any time in the future to remove the countertop from the frame members 14 and to slide an existing cabinet component 50 out of its receiving channels 38 on frame members 14 and to replace it with the desired cabinet component 50. Thus, not only can the color of the cabinet components be readily changed, but the nature of the cabinet component 50 can be readily changed in the present invention.

While the invention has been described in detail with particular reference to the preferred embodiment thereof, it will be understood that variations and modifications can be effected within the spirit and scope of the invention as previously described and as defined by the claims.

What is claimed is:

1. A system for assembling cabinet components in adjustable relationship to each other, comprising:

a. a base member comprising
   i. at least two spaced-apart, parallel longitudinally extending members, each having at least one surface for bearing a portion of the weight of the frame member secured thereon; and
   ii. means for rigidly interconnecting the two longitudinally extending members;

b. a plurality of frame members comprising
   i. an elongated top portion with opposed ends and which is parallel to the base member; and
   ii. first and second leg portions depending downwardly from each end of the top portion and terminating in bottom surfaces, a portion of each bottom surface being complimentary to a respective bearing surface on each longitudinally extending member of the base member;

c. means on the frame members and the base member for securing the frame members in an upright position at selected intervals along the length of the base member; and d. means on the frame members for receiving between adjacent pairs thereof a cabinet component, wherein the cabinet component comprises a counter top having a lower surface and an opposed upper surface and wherein the top portion of each frame member engages the lower surface of the counter top when the counter top and the frame member are in assembled relationship.

2. The system of claim 1, wherein the counter top is fastened to the top portion of each frame member.

3. A system for assembling cabinet components in adjustable relationship to each other, comprising:

(a) a base member comprising at least two spaced-apart, parallel longitudinally- extending members, each having at least one surface for bearing a portion of the weight of the frame member second thereon, and means for rigidly interconnecting the two longitudinally-extending members; and (b) a plurality of frame members comprising
   (i) an elongated top portion with opposed ends and which is parallel to the basic member;
   (ii) first and second leg portions depending downwardly from each end of the top portion and terminating on bottom surfaces, a portion of each surface being complimentary to a respective bearing surface on each longitudinally-extending member of the base member, wherein the leg portion of a frame member longitudinally carries on outwardly opening channel;
   (iii) means on the frame members and the base member for securing the frame members in an upright position at selected intervals along the length of the base member; and
   (iv) means on the frame members for receiving between adjacent pairs thereof a cabinet component.

4. The system of claim 3, wherein the leg portion has at least two opposed longitudinally extending faces, each of the faces having a channel therethrough.

5. The system of claim 4, wherein the channels open in opposed directions from each other.

6. The system of claim 5, wherein the channels are aligned with each other.

7. The system of claim 4, wherein the channels open perpendicularly to each other.

8. The system of claim 3, wherein the receiving means comprises the opposed leg portions of adjacent frame members, each of the leg portions carrying a channel that opens toward and is collinear with a channel on the adjacent frame member.

9. A system for supporting cabinet components in adjustable relationship to each other, the cabinet components having opposed side edges, comprising:

a. a base member, having at least two spaced-apart, parallel longitudinally extending members, each having at least one surface for bearing the portion of the weight of the frame member secured thereon and means for rigidly interconnecting the two longitudinally extending members;

b. a plurality of frame members having an elongated top portion with opposed ends and which is parallel to the base member, and first and second leg portions depending downwardly from each end of the top portion and terminating in bottom surfaces, a portion of each bottom surface being complimentary to a respective bearing surface on each longitudinally extending member of the base member;

c. means on the frame members and the base member for securing the frame members in an upright position at selected intervals along the length of the base member; and d. means comprising a longitudinally extending outwardly opening channel on the first and second leg portion of a frame member, wherein the channels are collinear with each other and open toward each other for receiving therein the opposed side edges of a cabinet component.

10. A system for modifying an existing cabinet assembly, comprising:

a. a plurality of frame members, having a top surface and bottom surface and at least two opposed longitudinally extending faces;

b. an existing cabinet assembly;

c. means for securing the frame members to the existing cabinet assembly; and d. means on the frame members for receiving between adjacent pairs thereof a cabinet component.

11. The system of claim 10, herein the cabinet components have opposing side edges, and wherein the receiving means comprises:

opposed faces of adjacent frame members, each face carrying an outwardly opening channel that opens toward and is collinear with a channel on the adjacent frame member for receiving therein the opposed edges of a cabinet component.

12. The system of claim 11 wherein the securing means comprises fastening means.

13. The system of claim 3, wherein the frame members extend upwardly at substantially right angles to the base member.

* * * * *